US005461731A

United States Patent [19]

Shida

[11] Patent Number: 5,461,731

[45] Date of Patent: Oct. 31, 1995

[54] SHIELD PLATE MOUNTING STRUCTURE IN HELMET

[75] Inventor: Masayuki Shida, Tokyo, Japan

[73] Assignee: Shei Kako Kabushiki Kaisha, Tokyo, Japan

[21] Appl. No.: 260,823

[22] Filed: Jun. 16, 1994

[30] Foreign Application Priority Data

Jun. 18, 1993 [JP] Japan ..... 5-147973

[51] Int. Cl.[6] ..... A42B 3/02

[52] U.S. Cl. ..... 2/424

[58] Field of Search ..... 2/410, 411, 424, 2/425, 15, 10, 9, 422, 6.5

[56] References Cited

U.S. PATENT DOCUMENTS 5,062,162 11/1991 Kamata ..... 2/424
5,185,889 2/1993 Kamata ..... 2/424

FOREIGN PATENT DOCUMENTS 4-163306 6/1992 Japan .
5214604 8/1993 Japan ..... 2/424
6073604 3/1994 Japan ..... 2/410

*Primary Examiner*—C. D. Crowder
*Assistant Examiner*—Michael A. Neas
*Attorney, Agent, or Firm*—Armstrong, Westerman, Hattori, McLeland & Naughton

[57] ABSTRACT

A cap body is formed with a support sleeve and an arcuate guide projection wall which are concentric with a mounting base plate. The support sleeve is formed with a first notch and a first guide groove. A first engage claw is projected from a pivot shaft of a shield plate and enters and comes out of the first notch. The first guide groove engages with the first engage claw through the first notch. A lock lever is pivotally supported by the mounting base plate, and is provided with a first and second lock claws which engage and disengage with first and second engage claws in accordance with a locking position and an unlocking position of the lock lever. Therefore, at the attaching and detaching position of the shield plate, the shield can be locked at least at two points by a single lock member and thus, a coupled strength of the shield plate is increased.

6 Claims, 9 Drawing Sheets

SHIELD PLATE MOUNTING STRUCTURE IN HELMET

BACKGROUND OF THE INVENTION

1. Field of the Invention

The present invention relates to a shield plate mounting structure in a helmet for mounting a shield plate to a mounting base plate secured to an outer surface of a cap body for turning or pivotal movement to open and close a window in the cap body.

2. Description of the Prior Art

There is a conventionally known structure for mounting a shield plate to a cap body without using machine screws, which includes a support sleeve formed on an outer side of a mounting base plate and having a notch in its peripheral wall and a guide groove in its inner peripheral surface, a stub shaft capable of being fitted into the support sleeve, an engaging claw projecting from an outer peripheral surface of the stub shaft and capable of being brought into engagement into the guide groove via the notch, the stub shaft and the lock claws being formed on an inner surface at an end of a shield plate, and a lock member slidably carried on the mounting base plate and provided with a lock claw adapted for engagement and disengagement with and from the engage claw in the notch in accordance with the a locking position and an unlocking position of the lock member, as disclosed, for example, in Japanese Patent Application Laid-open No. 163306/92.

In the prior art structure of the above-described type, only one engage claw and one lock claw are engaged with each other in a attachable and detachable position of the shield plate and hence, it is difficult to increase the coupled strength of the shield plate.

Accordingly, it is an object of the present invention to provide a shield plate mounting structure in a helmet of the type described above, which is simplified and in which the shield plate can be locked at least at two points by a single lock member to provide an increased coupled strength of the shield plate.

SUMMARY OF THE INVENTION

To achieve the above object, according to the present invention, there is provided a shield plate mounting structure in a helmet for turnably mounting a shield plate to a mounting base plate secured to an outer side surface of a cap body for opening and closing a window in the cap body, comprising a support sleeve provided at a peripheral wall thereof with a first notch, and at an inner peripheral surface thereof with a first guide groove, an arcuate guide projection wall disposed concentrically with and outside the support sleeve and provided at a peripheral wall thereof with a second notch, and at an outer peripheral surface thereof with a second guide groove, both of the support sleeve and the arcuate guide projection wall being formed on an outer side surface of the mounting base plate, a pivot shaft capable of loosely fitting into the support sleeve, a first engage claw projecting from an outer peripheral surface of the pivot shaft and capable of engaging with the first guide groove through the first notch, a second engage claw capable engaging with the second guide groove thorough the second notch, the pivot shaft and the first and second engage claws being formed on an inner side surface of an end of the shield plate, a lock lever pivotally supported on the mounting base plate for swinging movement between a locking position and an unlocking position and provided with first and second lock claws capable of being brought into and out of engagement with the first and second engage claws within the first and second notches, respectively, in accordance with the locking and unlocking positions of the lock lever, and a lock spring connected to the lock lever for biasing the lock lever toward the locking position.

With the above feature, the shield plate can be locked by the single lock lever at two points spaced by different distances from the pivot shaft and therefore, it is possible to provide an increased coupled strength of the shield plate at an attachable and detachable position thereof, while avoiding a complication of the structure, and also to facilitate the attaching and detaching operations.

The above and other objects, features and advantages of the invention will become apparent from the following description of a preferred embodiment taken in conjunction with the accompanying drawings.

BRIEF DESCRIPTION OF THE DRAWINGS

The drawings illustrate a preferred embodiment of the present invention, wherein.

DESCRIPTION OF THE PREFERRED EMBODIMENT

The present invention will now be described by way of a preferred embodiment in connection with the accompanying drawings.

Figure 1:
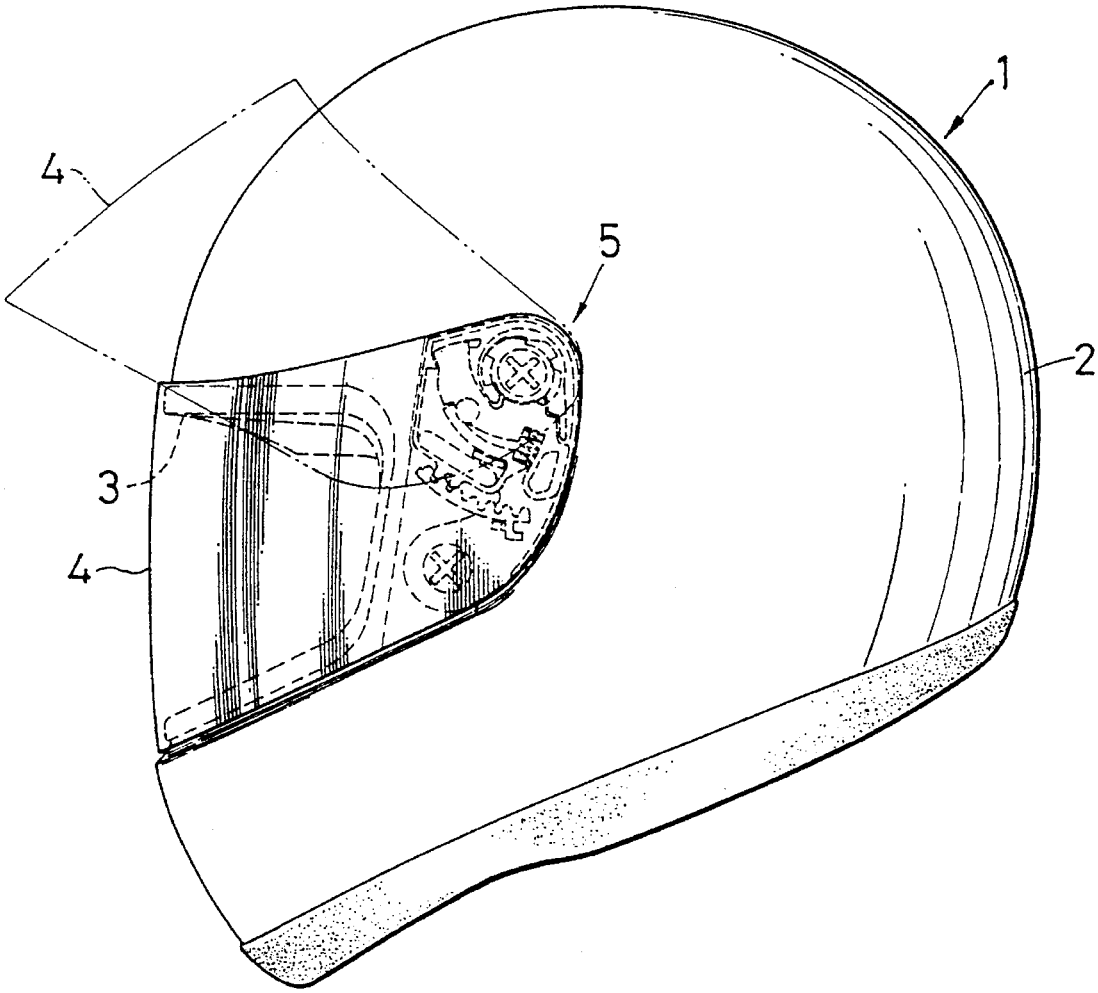
FIG. 1 is a side view of a helmet having a shield plate mounting structure according the present invention, shown in a fully closed state of a shield plate.

Referring first to FIG. 1, a shield plate 4 is vertically pivotally mounted at its left and right opposite ends to left and right sidewalls of cap body 2 of a full-face type helmet 1 by a mounting structure 5 according to the present invention for opening and closing a window 3 opened in a front wall of the cap body. The entire shield plate 4, including the opposite ends, is formed from a material such as a transparent or light-permeable synthetic resin. Therefore, portions of the mounting structure 5 can be seen through an outer surface of the shield plate 4 at each end thereof. The outer surface of each end of the shield plate 4 is a smooth surface which is not covered with other members.

Figure 2:
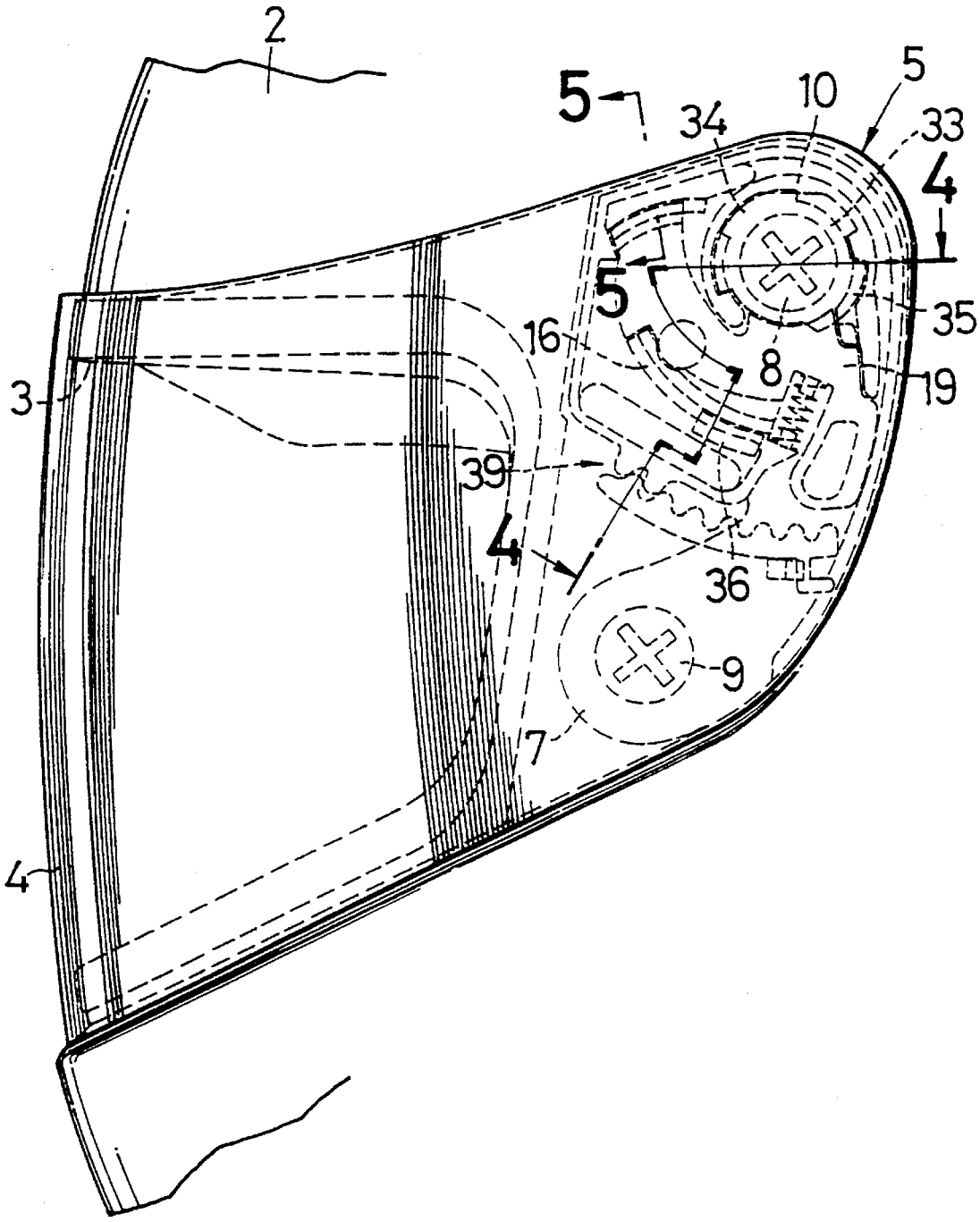
FIG. 2 is an enlarged view of an essential portion shown in FIG. 1.
Figure 3:
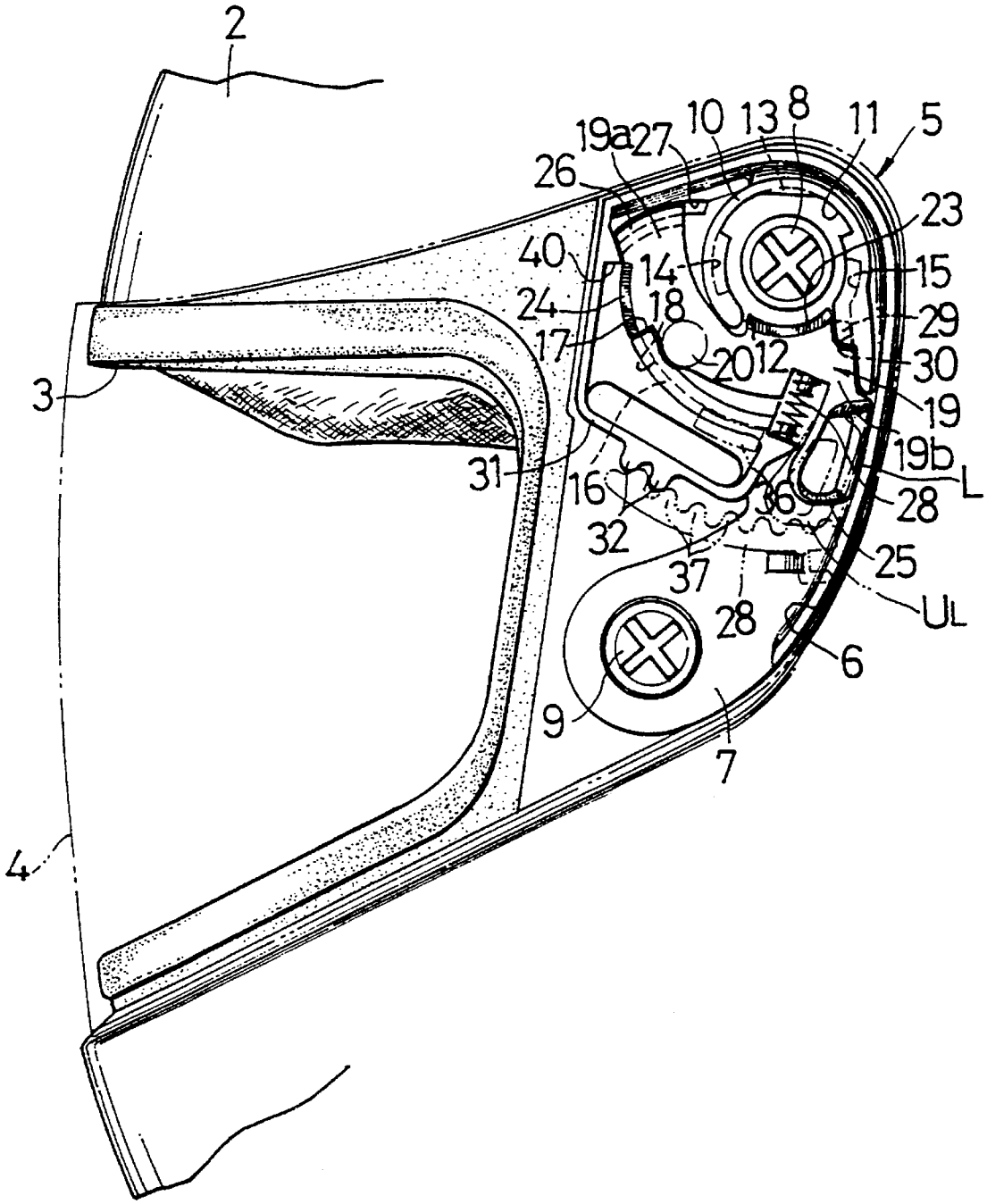
FIG. 3 is an enlarged side view of the essential portion of the helmet with the shield plate removed.
Figure 4:
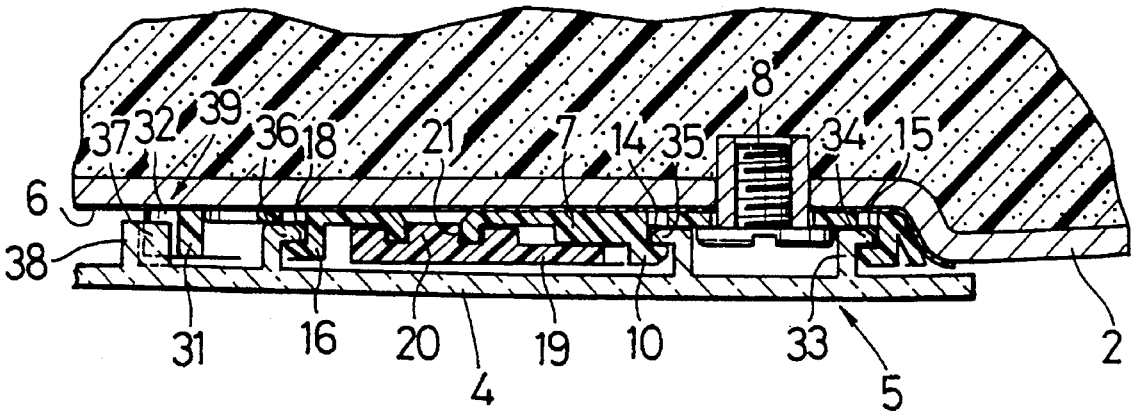
FIG. 4 is a sectional view taken along a line 4—4 in FIG. 2.
Figure 5:
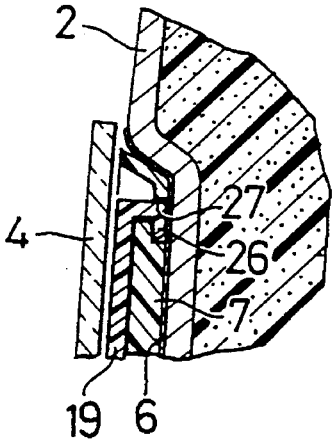
FIG. 5 is a sectional view taken along a line 5—5 in FIG. 2.

The mounting structure 5 will be described below. As shown in FIGS. 2 and 3, a shallow recess 6 is defined in each of left and right outer sides of the cap body 2. A mounting base plate 7 is secured at two points, i.e., upper and lower points to a bottom surface of the recess 6 by means of machine screws 8 and 9.

Figure 7:
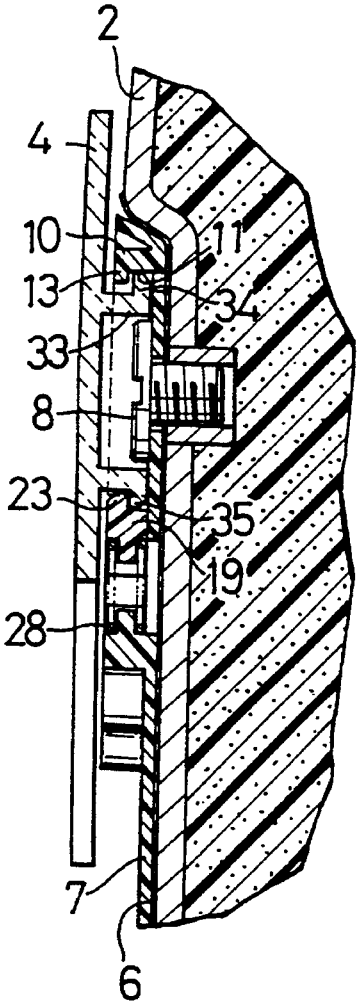
FIG. 7 is a sectional view taken along a line 7—7 in FIG. 6.

As shown in FIGS. 2 to 5 and 11, a support sleeve 10 is integrally formed on a surface of the mounting base plate 7 to surround the upper machine screw 8. A wide fan-shaped recess 11 is provided in an upper portion of an inner wall of the support sleeve 10, and a narrow notch 12 is provided in a lower portion of the support sleeve 10. A visor-shaped temporarily fixing projection 13 (see FIGS. 3 and 7) is formed on an upper edge of a central portion of the fan-shaped recess 11. Further, provided in the inner wall of the support sleeve 10 are a guide groove 14 extending downwardly from a front end of the fan-shaped recess 11, and a guide groove 15 extending upwardly from a rear end of the notch 12.

An arcuate guide projection wall 16 concentric with the support sleeve 10 is formed at a distance spaced forwardly and downwardly apart from the support sleeve 10, and is provided at its upper portion with a notch 17. The guide projection wall 16 also includes an engage groove 18 in its outer peripheral surface.

A lock lever 19 is disposed between the support sleeve 10 and the guide projection wall 16. A stub shaft 20 integral with the lever 19 is rotatably received in a shaft bore 21 which is formed in the mounting base plate 7 between both the notches 12 and 17.

The lock lever 19 is formed into an arched shape having an upper arm 19*a* extending upwardly from the stub shaft 20, and a lower arm 19*b* extending downwardly and rearwardly from the stub shaft 20. A first lock claw 23 is provided on the lower arm 19*b* for placement into and out of the notch 12 of the support sleeve 10, and a second claw 24 is provided on the upper arm 19*a* for placement into and out of the notch 17 of the guide projection wall 16. Outer edges of tip ends of the first and second lock claws 23 and 24 are formed with slopes 23*a* and 24*a* (see FIG. 11).

A ring-like knob 25 is formed at a tip end of the lower arm 19*b*, and a guide claw 26 is formed at a tip end of the upper arm 19*a*.

Figure 6:
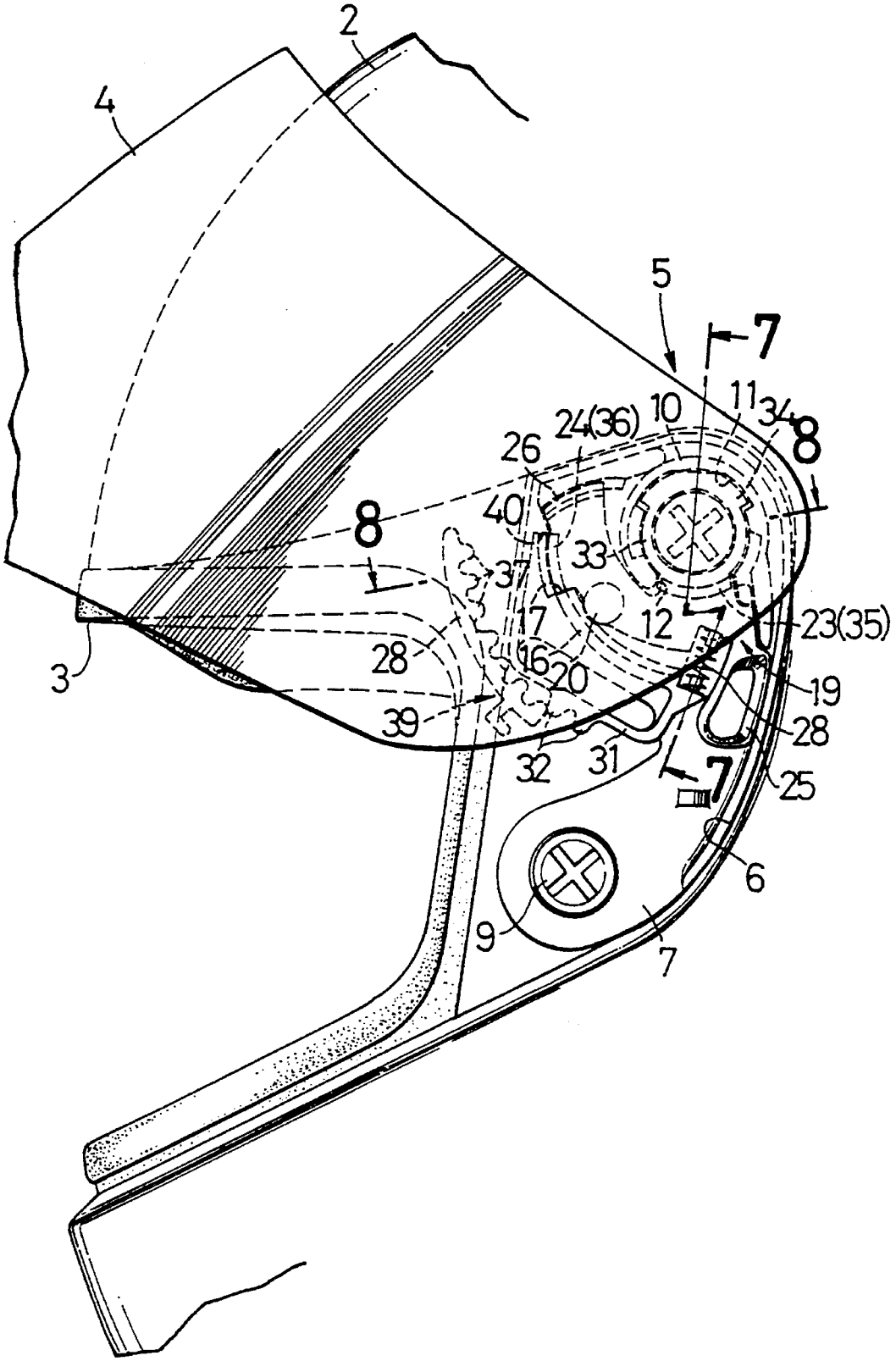
FIG. 6 is an enlarged side view of the essential portion of the helmet shown in a fully opened state of the shield plate.

The guide claw 26 is arcuate about the stub shaft 20. The mounting base plate 7 is provided with a guide bore 27 which is arcuate about the shaft bore 21. The guide claw 26 prevents the lock lever from being separated from the mounting base plate 7 by engaging with the guide bore 27 (see FIG. 5). The guide claw 26 also serves to define a locking position L of the lock lever 19 and an unlocking position $U_L$ of the lock lever 19 by abutting against one end wall and the other end wall of the guide bore 27. In the locking position L (see FIG. 6) of the lock lever 19, the first and second lock claws 23 and 24 enter the notches 12 and 17, respectively, and in the unlocking position $U_L$ (see FIG. 9), the first and second lock claws 23 and 24 come out of the notches 12 and 17, respectively.

A lock spring 28 (see FIG. 7) is compressed between the mounting base plate 7 and the lock lever 19 for biasing the lock lever 19 toward the locking position L.

Further, in order to prevent the disengagement of the lock lever 19, a projection 29 (see FIG. 3) is formed on the lock lever 19, while a recess 30 (see FIG. 3) is provided in the support sleeve 10. The projection 29 and the recess 30 are engaged with each other when the lock lever 19 is in the locking position L.

Further, a resilient arm 31 is integrally coupled at its opposite ends to the mounting base plate 7 in front of the guide projection wall 16. The resilient arm 31 is provided at a front surface of a central portion thereof with a single or a plurality of stationary click teeth 32.

On the other hand, a pivot shaft 33 is integrally projected on an inner surface of each of left and right ends of the shield plate 4. The pivot shaft 33 can be loosely fitted into the support sleeve 10. Lock claws 34 and 35 are formed on an outer periphery of the pivot shaft 33 for engagement into the guide grooves 14 and 15 through the fan-shaped recess 11 and the notch 12, respectively. Outer peripheral edges of the engage claws 34 and 35 are formed into slopes 34*a* and 35*a* (see FIG. 11) which slidably contact with the temporarily fixing projection 13 and the slope 23*a* of the first lock claw 23, respectively.

A engage claw 36 is formed on an inner surface of each of left and right ends of the shield plate 4. The engage claw 36 can engage with the guide groove 18 through the notch 17 of the guide projection wall 16. The engage claw 36 is also formed at one side thereof of a tip end thereof with a slope 36*a* (see FIG. 1) which can slidably contact with the slope 24*a* of the second lock claw 24.

Further, the shield plate 4 is integrally formed with a projection wall 38 which includes a large number of click teeth 37, 37—projectingly provided on an inner peripheral surface thereof for engagement with the stationary click teeth 32 with a resilient force of the resilient arm 31. The projection wall 38 is arcuate about the pivot shaft 33. Thus, the resilient arm 31 and the projection wall 38 constitute a click stop mechanism 39 for stopping the shield plate 4 at each of turned positions.

The fully opened position of the shield plate 4 is defined by abutment of the engage claw 36 against the upper end wall, i.e., a stopper wall 40 of the notch 17. This fully opened position is an attachable and detachable position of the shield plate 4 in which the engage claw 34 is aligned with the fan-shaped recess 11; the engage claw 35 is aligned with the notch 12, and the engage claw 36 is aligned with the notch 17. The shield plate 4 covers the entire lock lever 19 at the fully closed position. Therefore, in the fully closed position, the lock lever 19 is inoperable.

The operation of this embodiment will be described below.

To attach the shield plate 4 to the cap body 2, the pivot shaft 33 of the shield plate 4 is aligned with the support sleeve 10 of the mounting base plate 7 in the fully opened position of the shield plate 4. As a result, the engage claws 34 and 35 of the pivot shaft 33 come to positions in which they can enter the fan-shaped recess 11 and the notch 12, and the other engage claw 36 comes to a position in which it can be admitted into the notch 17 of the guide projection wall 16.

Figure 8:
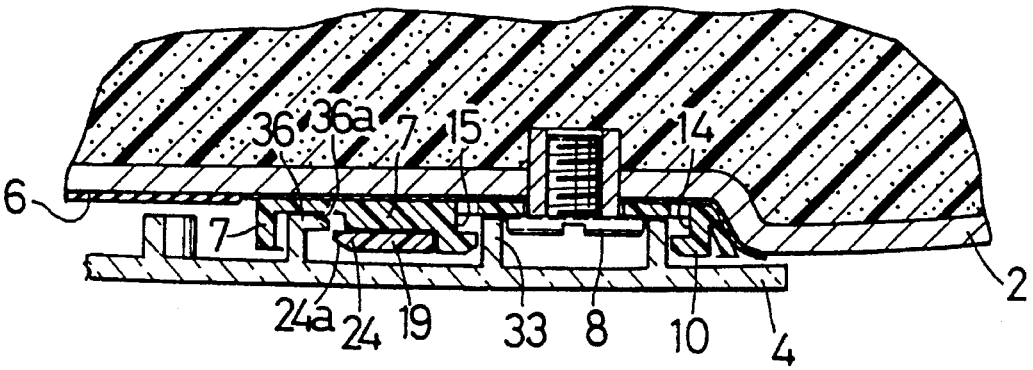
FIG. 8 is a sectional view taken along a line 8—8 in FIG. 6.
Figure 10:
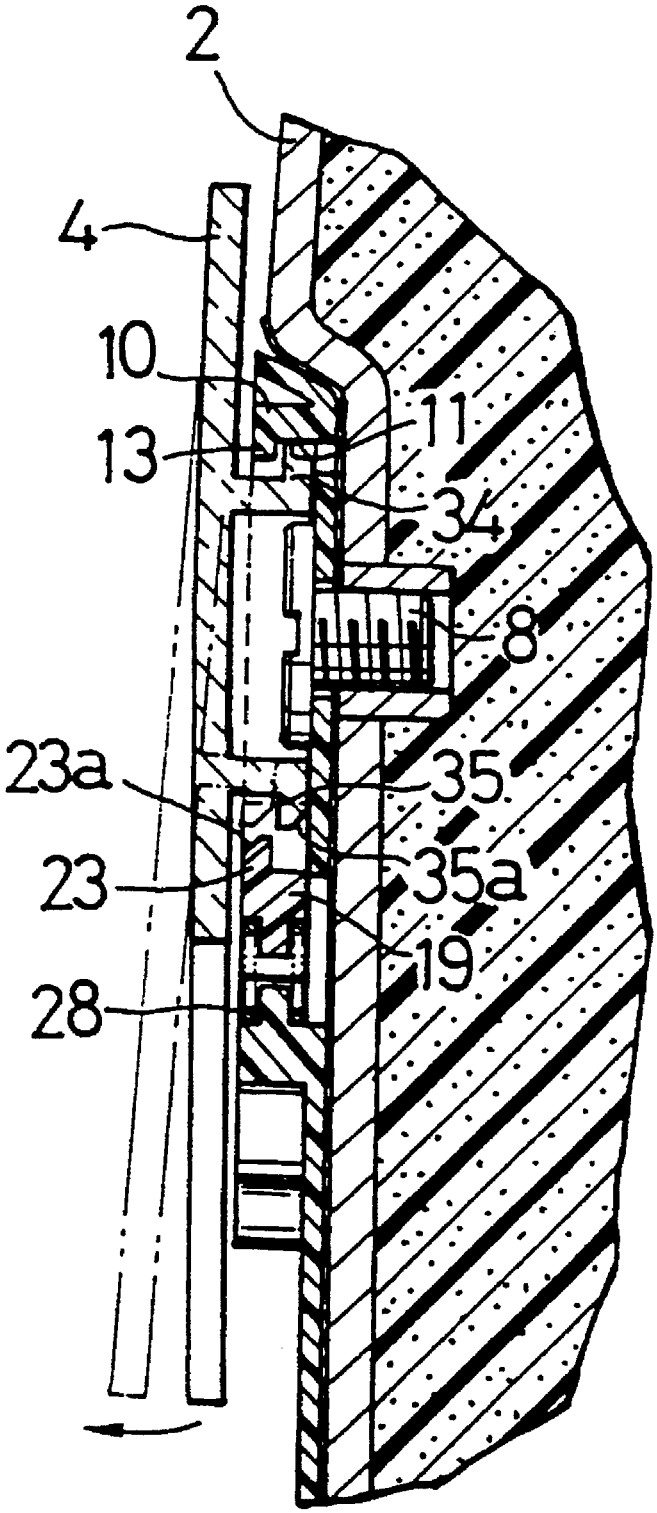
FIG. 10 is a sectional view taken along a line 10—10 in FIG. 9.
Figure 11:
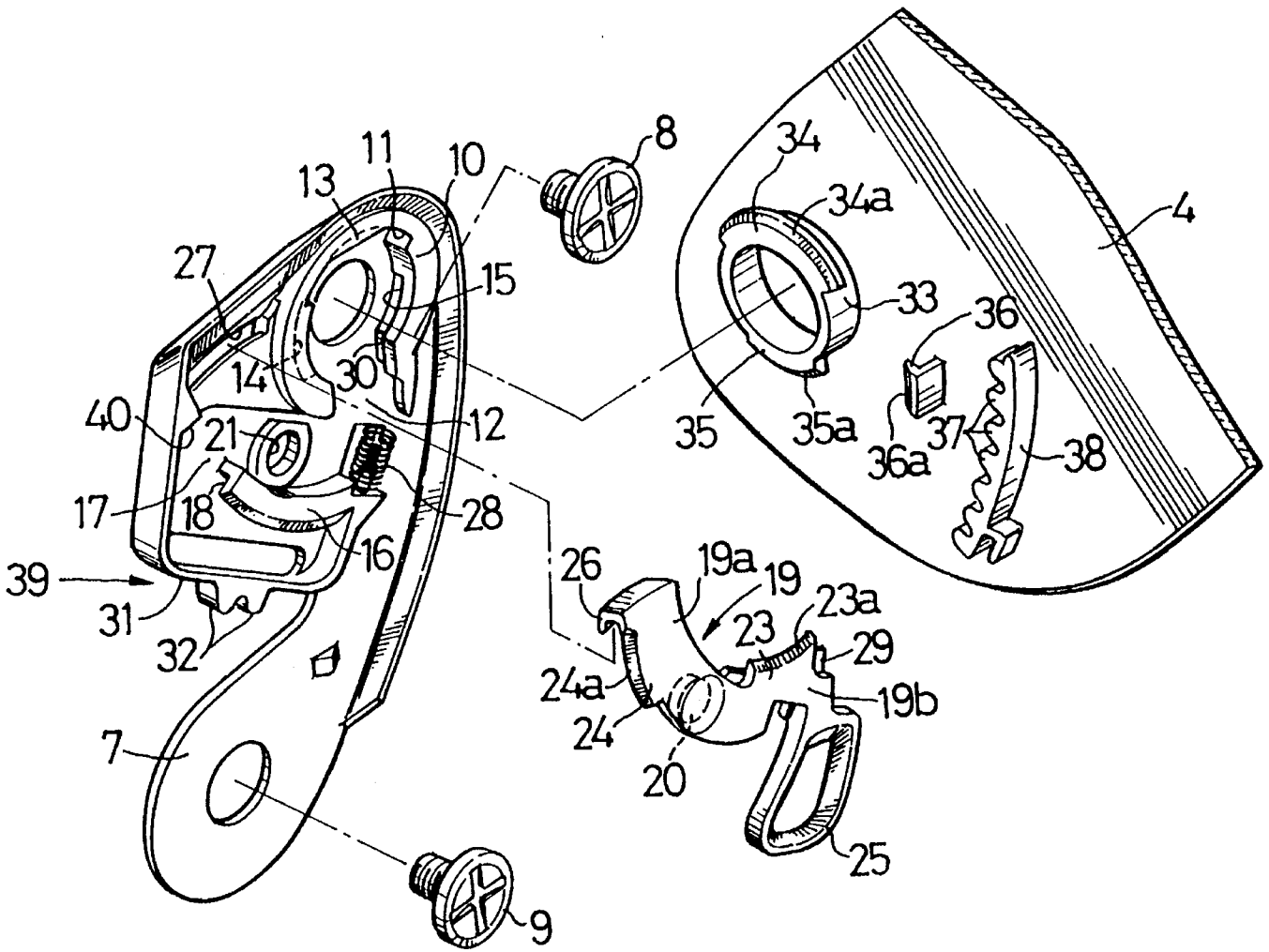
FIG. 11 is an exploded perspective view of the shield plate mounting structure according to the present invention.

Thereupon, a user of the helmet slightly grasps the end of the shield plate 4 to put it into the fan-shaped recess 11 of the support sleeve 10 while passing the claw 34 under the temporarily fixing projection 13 (see a state shown in FIG. 10), and then strongly urges the end of the shield plate 4 toward the mounting base plate 7. In doing so, the engage claw 35 enters the notch 12 of the support sleeve 10, while the slope 23*a* of the first lock claw 23 of the lock lever 19 is once forced back by the slope 35*a* of the engage claw 35. And the remaining engage claw 36 also inters the notch 17 of the guide projection wall 16, while the slope 24*a* of the second lock claw 24 is once forced back by the slope 36*a* of the engage claw 36. Thus, the lock lever 19 is urged into the unlocking position $U_L$ in such a manner that the lever 19 is once retreated out of the notches 12 and 17 corresponding to the first and second lock claws 23 and 24. However, when the engage claws 35 and 36 enter the notches 12 and 17, the lock lever 19 is immediately returned to the original locking position L with the resilient force of the lock spring 28, so that the first and second lock claws 23 and 24 are brought into engagement with the engage claws 35 and 36, respectively (see FIGS. 7 and 8). This engagement cannot be released, unless the lock lever 19 is turned to the unlocking position $U_L$. Such a mounting operation can easily be conducted while seeing the various portions of the mounting structure 5 through the outer surface of the shield plate 4 at each end.

As described above, the lock lever 19 has the first and second lock claws 23 and 24 which are brought into engagement with the engage claws 35 and 36 of the shield plate 4 in the notches 12 and 17. Therefore, the shield plate 4 can be locked by the single lock lever 19 at two points spaced from the pivot shaft 33 by different distances, thereby providing an increased coupled strength of the shield plate 4.

The shield plate 4 is mounted in this manner, and at the same time, in the click stop mechanism 39, upper one of the stationary click teeth 32, 32—and the lowermost one of the movable click teeth 37, 37—are brought into engagement with each other by the resilient force of the resilient arm 31 for operation. Thereupon, if the shield plate 4 is turned downwardly about the pivot shaft 33, engagement positions of the three engage claws 34, 35 and 36 of the shield plate 4 are shifted to the three guide grooves 14, 15 and 18 in the mounting base plate 7, leading to further reliable coupled states of the engage claws 34, 35 and 36 to the mounting base plate 7. Moreover, opposite ends of the outer surface of the cap body is a smooth surface which is not covered with the other member and therefore, even when the user wearing the cap body 2 drives, for example, a motorcycle at a high speed, travel wind is permitted to smoothly flow along the outer surface of the shield plate 4, without generation of no whistle made by traveling wind.

On the other hand, in the click stop mechanism 39, whenever the shield plate 4 is turned through a predetermined unit angle, the engaged positions of the stationary and movable click teeth 32 and 37 are changed while flexing the resilient arm 31 so that the user can feel such adjustment, and the shield plate 4 can be maintained at its turned position.

In this case, particularly, the resilient arm 31 provided at its central portion with the stationary teeth 32, 32 is connected at its opposite ends of the arm 31 to the mounting base plate 4 in a straddle manner. Therefore, when the turning direction of the shield plate 4 is changed from an upward direction to a downward direction and vice versa, even if an urging point of the movable click tooth 37 against the stationary click tooth 32 is shifted from one side to the other side of the tooth, no change occurs in total arm length from such urging point to the opposite ends of the resilient arm 31 and hence, the resistance to the flexing of the resilient arm 31 is also varied. Therefore, the user can always feel the adjustment of the shield plate 4 with complete reliability.

Figure 9:
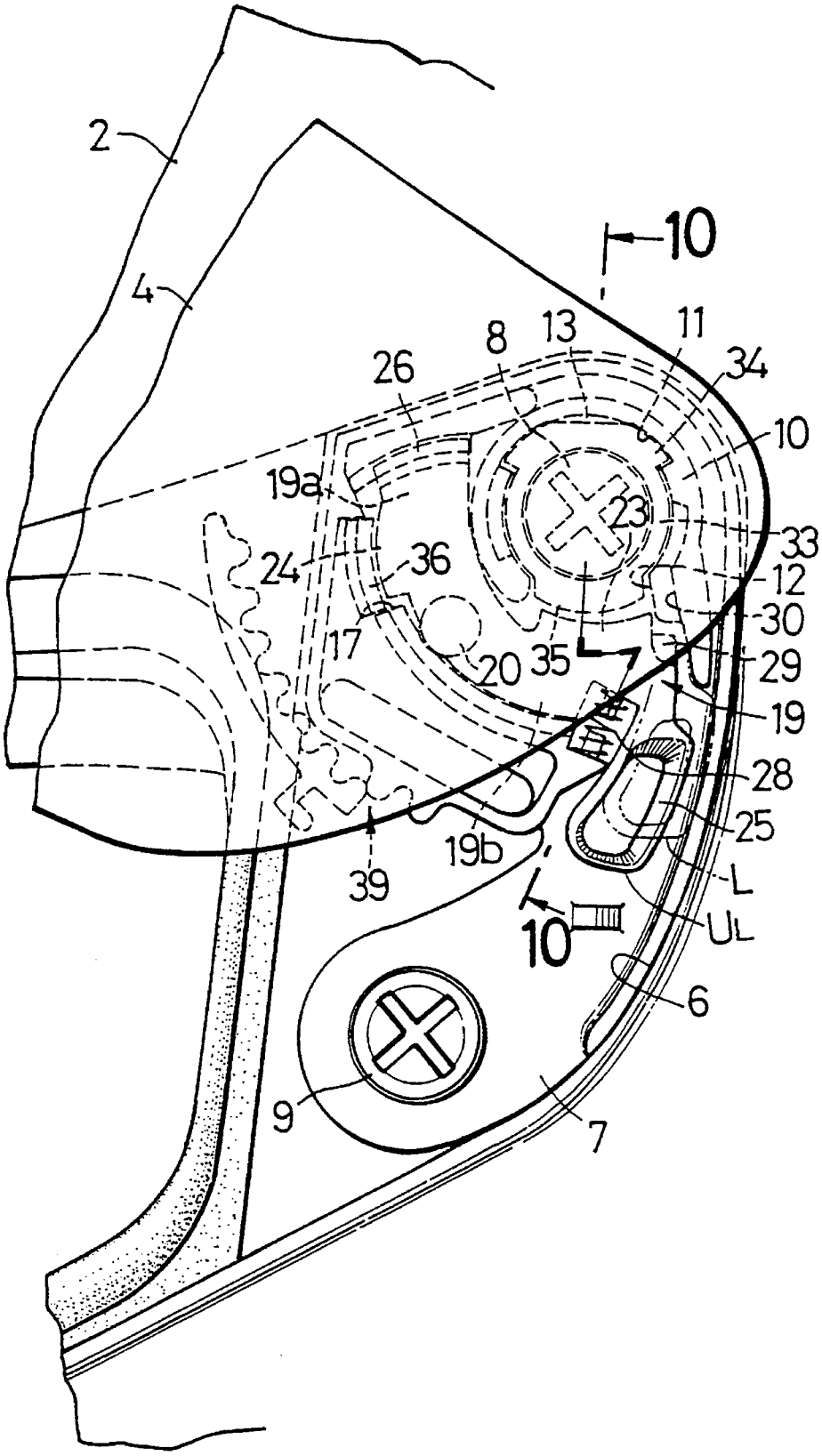
FIG. 9 is an enlarged side view of the essential portion of the helmet for explaining how the shield plate is removed.

To remove the shield plate 4 from the cap body 2, the shield plate 4 is turned again to the fully opened position, as shown in FIG. 9, and then, the user puts his or her finger onto the knob 25 to turn the lock lever 19 to the unlocking position $U_L$ against a force of the lock spring 28, thereby disengaging the first and second lock claws 23 and 24 from the corresponding the engage claws 35 and 36. Then, the user puts his or her finger on the lower edge of the end of the shield plate 4 to pull it outward (in a direction indicated by a n arrow in FIG. 10). In this manner, all the engage claws 34, 35 and 36 of the shield plate 4 can be disengaged from the fan-shaped recess 11 and the notches 12 and 17.

Although the embodiment of the present invention has been described in detail, it will be understood that the present invention is not limited thereto, and various modifications in design may be made without departing from the spirit and scope of the invention defined in claims. For example, the attachable and detachable position of the shield plate 4 may be established in the middle between the fully opened position and the fully closed position. The cap body may be formed into a jet type.

What is claimed is:

1. A shield plate mounting structure in a helmet for turnably mounting a shield plate to a mounting base plate secured to an outer side surface of a cap body for opening and closing a window in the cap body, comprising a support sleeve provided at a peripheral wall thereof with a first notch, and at an inner peripheral surface thereof with a first guide groove, an arcuate guide projection wall disposed concentrically with and outside said support sleeve and provided at a peripheral wall thereof with a second notch, and at an outer peripheral surface thereof with a second guide groove, both of said support sleeve and the arcuate guide projection wall being formed on an outer side surface of said mounting base plate, a pivot shaft capable of loosely fitting into said support sleeve, a first engage claw projecting from an outer peripheral surface of said pivot shaft and capable of engaging with said first guide groove through said first notch, a second engage claw capable engaging with said second guide groove thorough said second notch, said pivot shaft and said first and second engage claws being formed on an inner side surface of an end of said shield plate, a lock lever pivotally supported on said mounting base plate for swinging movement between a locking position and an unlocking position and provided with first and second lock claws capable of being brought into and out of engagement with said first and second engage claws within said first and second notches, respectively, in accordance with the locking and unlocking positions of said lock lever, and a lock spring connected to said lock lever for biasing said lock lever toward the locking position.

2. A shield plate mounting structure in a helmet according to claim 1, wherein said lock lever comprises first and second arms extending in opposite directions from a stub shaft which supports said lock lever on said mounting base plate, and a knob connected to one of said arms, said first and second arms being provided with said first and second lock claws, respectively, said first and second lock claws being formed at their outer edges of tip ends with slopes for guiding the engagement of said first and second engage claws.

3. A shield plate mounting structure in a helmet according to claim 2, wherein said lock lever is provided with a guide claw which is arcuate about the stub shaft, and said mounting base plate being provided with an arcuate guide bore for slidable engagement by said guide claw.

4. A shield plate mounting structure in a helmet according to claim 2 or 3, wherein said mounting base plate is formed with a recess, and said lock lever is formed with a projection, said recess and said projection being engaged with each other when said lock lever is in said locking position.

5. A shield plate mounting structure in a helmet according to claim 2 or 3, wherein when the shield plate is in its fully closed state, said knob of said lock lever is disposed so as to be covered with said shield plate so that the knob can not be operated.

6. A shield plate mounting structure in a helmet according to claim 2 or 3, wherein the entire shield plate is formed from a light-permeable synthetic resin, so that said mounting base plate, said lock lever, said support sleeve and said pivot shaft can be seen through the outer surface of an end of said shield plate at its end, and said outer surface of the end of said shield plate is formed into a smooth surface which is not covered with any other member.

* * * * *